US007952044B2

(12) United States Patent
Lee

(10) Patent No.: US 7,952,044 B2
(45) Date of Patent: May 31, 2011

(54) ROCKER SWITCH AND ACTUATOR SUBASSEMBLY THEREFOR

(75) Inventor: Davin R. Lee, Watertown, WI (US)

(73) Assignee: Eaton Corporation, Cleveland, OH (US)

( * ) Notice: Subject to any disclaimer, the term of this patent is extended or adjusted under 35 U.S.C. 154(b) by 358 days.

(21) Appl. No.: 12/323,607

(22) Filed: Nov. 26, 2008

(65) Prior Publication Data

US 2010/0126838 A1 May 27, 2010

(51) Int. Cl.
*H01H 23/00* (2006.01)

(52) U.S. Cl. ..... 200/339; 200/315

(58) Field of Classification Search ..... 200/5 R, 200/310, 313, 315, 339, 553, 557, 558, 559, 200/561; 341/35; 345/184
See application file for complete search history.

(56) References Cited

U.S. PATENT DOCUMENTS

| | | | | |
|---|---|---|---|---|
| 4,024,367 | A | 5/1977 | Kodaira et al. | |
| 4,221,941 | A | 9/1980 | Genovese | |
| 4,321,442 | A | 3/1982 | Tanaka et al. | |
| 4,528,431 | A | 7/1985 | Coleman, III | |
| 4,697,053 | A | 9/1987 | Lockard | |
| 4,803,317 | A | 2/1989 | Sutoh et al. | |
| 5,053,591 | A | 10/1991 | Theurer | |
| 5,158,172 | A | 10/1992 | Roeser et al. | |
| 5,561,279 | A * | 10/1996 | Hattori et al. | 200/6 R |
| 5,693,920 | A | 12/1997 | Maeda | |
| 5,810,109 | A | 9/1998 | Chu | |
| 5,880,419 | A | 3/1999 | Chou | |
| 6,339,201 | B1 | 1/2002 | Balaban et al. | |
| 6,380,500 | B1 | 4/2002 | Lin | |
| 6,459,060 | B1 | 10/2002 | Bartok | |
| 6,545,239 | B2 | 4/2003 | Spedale et al. | |
| 6,576,855 | B2 | 6/2003 | Levendis et al. | |
| 6,914,202 | B2 * | 7/2005 | Sugimoto et al. | 200/1 B |
| 6,919,523 | B1 * | 7/2005 | Lai | 200/402 |
| 7,026,565 | B1 | 4/2006 | Lee | |
| 7,105,762 | B1 | 9/2006 | Lee | |
| 7,122,752 | B2 * | 10/2006 | Nagai et al. | 200/315 |
| 7,202,431 | B2 * | 4/2007 | Gauzin | 200/339 |
| 7,439,459 | B2 * | 10/2008 | Hyun et al. | 200/5 R |
| 7,576,293 | B2 * | 8/2009 | Nagai et al. | 200/339 |

* cited by examiner

*Primary Examiner* — Michael A Friedhofer
(74) *Attorney, Agent, or Firm* — Martin J. Moran

(57) ABSTRACT

An actuator subassembly is provided for a rocker switch including a housing, a plunger and a number of contact elements. The actuator subassembly includes an operating member movably coupled to the rocker switch housing at or about an opening, and including at least one projection which extends into a cavity of the housing. A sub-actuator is removably coupled to such projection and includes a shaped portion, a number of contacting portions and a depth. The shaped portion cooperates with a plunger to provide a plurality of operating characteristics of the operating member, including a plurality of positions thereof. Each contacting portion contacts a corresponding one of the contact elements when the operating member is disposed in a corresponding one of the positions. When the actuator subassembly is coupled to the housing, the depth of the sub-actuator occupies less than one-third of the width of the cavity.

20 Claims, 7 Drawing Sheets

ROCKER SWITCH AND ACTUATOR SUBASSEMBLY THEREFOR

BACKGROUND

1. Field

The disclosed concept relates generally to electrical switching apparatus and, more particularly, to electrical switching apparatus such as, for example, rocker switches. The disclosed concept also relates to actuator subassemblies for rocker switches.

2. Background Information

Rocker switches are generally old and well known in the art. As shown in FIG. 1, a rocker switch 2 generally includes a housing 4 and an actuator, such as the pivotal button or operating member 6, shown, which can be actuated from the exterior of the housing 4. The housing 4 is typically made from a non-conductive material, such as a heat-resistant plastic, and is structured to define a cavity 8. At the base 10 of the housing 4 are a plurality of terminals (e.g., the rocker switch 2 of FIG. 1 has first, second and third terminals 12, 14, 16). Typically, the first and third terminals 12, 16 are load terminals and the second or middle terminal 14 is the line terminal. Each terminal 12, 14, 16 extends from outside the housing 4 into the cavity 8. At least one of the terminals 12, 14, 16 is electrically connected to a stationary contact disposed within the housing cavity 8. In the example of FIG. 1, one stationary contact 18 is coupled to first terminal 12 and a second stationary contact 20 is coupled to third terminal 16. Movable contacts 22, 24 coupled to opposite ends of a shaped member, such as the deflective conductor 26, shown, are structured to engage the respective stationary contacts 18, 20.

The profile of the deflective conductor 26 dictates the operating characteristics (e.g., without limitation, type of action, such as, momentary or sustained; number and location of positions of the operating member; operating forces) of the rocker switch 2. Specifically, the operating member 6 includes a spring 28 adapted to push on a plunger 30 which, in turn, slides over the surface of the shaped member 26 as the operating member 6 is moved, in order to, for example, open and close the electrical contacts 20, 24 or 18, 22 (e.g., stationary contact 18 and movable contact 22 of FIG. 1 are closed, while contacts 20, 24 are open).

It is sometimes desirable to change one or more of these operating characteristics, for example, after the rocker switch 2 has been assembled and installed into the final product. Under such circumstances, it is preferable to accomplish this object relatively quickly and easily, without entirely disassembling the product and/or replacing a substantial portion of the entire rocker switch 2. However, when modifying the rocker switch 2 to change the operating characteristics thereof, it is necessary to consider and accommodate the accumulation or "stack up" of dimensional tolerance variations among the various assembled components of the rocker switch 2, so that it is ensured the switch 2 will continue to operate properly.

It is also desirable that the internal components (e.g., without limitation, shaped member 26; spring 28; plunger 30) of the rocker switch 2 be relatively small such that they occupy relatively little space within the rocker switch housing 4. Among other reasons, this is important because it ensures that there will be sufficient space within the housing 4 to allow for a lighting element (e.g., without limitation, light pipe(s)) (not shown in the example of FIG. 1) to illuminate the entire operating member 6 of the rocker switch 2.

There is, therefore, room for improvement in rocker switches and in actuator subassemblies therefor.

SUMMARY

These needs and others are satisfied by embodiments of the disclosed concept, which are directed to an actuator subassembly for a rocker switch. The actuator subassembly includes a sub-actuator that is relatively small (e.g., without limitation, thin), such that it can be coupled to the operating member (e.g., without limitation, pivotal button) of the rocker switch to provide a wide variety of desired rocker switch operating characteristics, yet it occupies relatively little space within the rocker switch housing.

As one aspect of the disclosed concept, an actuator subassembly is provided for a rocker switch. The rocker switch comprises a housing, a plunger and a number of contact elements. The housing includes an exterior, an interior having a cavity, and an opening providing access from the exterior to the cavity. The plunger is movably coupled to the housing within the cavity. The cavity has a width. The actuator subassembly comprises: an operating member structured to be movably coupled to the housing of the rocker switch at or about the opening, the operating member including at least one projection structured to extend into the cavity of the housing; and a sub-actuator structured to be removably coupled to the at least one projection of the operating member between the operating member and the plunger of the rocker switch, the sub-actuator comprising a shaped portion, a number of contacting portions and a depth, the shaped portion being structured to cooperate with the plunger to provide a plurality of operating characteristics of the operating member, the operating characteristics including a plurality of positions of the operating member, each of the number of contacting portions being structured to contact a corresponding one of the number of contact elements of the rocker switch when the operating member is disposed in a corresponding one of the plurality of positions. When the actuator subassembly is coupled to the housing of the rocker switch, the depth of the sub-actuator is structured to occupy less than one-third of the width of the cavity of the housing.

As another aspect of the disclosed concept, a rocker switch comprises: a housing comprising an exterior, an interior forming at least one cavity having a width, and a number of openings each providing access from the exterior to a corresponding one of the at least one cavity; a number of plungers each being movably coupled to the housing within the corresponding one of the at least one cavity; a number of contact elements; and at least one actuator subassembly comprising: an operating member movably coupled to the housing at or about a corresponding one of the number of openings, the operating member including at least one projection extending into the corresponding one of the at least one cavity, and a sub-actuator removably coupled to the at least one projection of the operating member, the sub-actuator comprising a shaped portion, a number of contacting portions and a depth, the shaped portion being cooperable with a corresponding one of the number of plungers to provide a plurality of operating characteristics of the operating member, the operating characteristics including a plurality of positions of the operating member, each of the number of contacting portions of the sub-actuator contacting a corresponding one of the number of contact elements when the operating member is disposed in a corresponding one of the plurality of positions. When the at least one actuator subassembly is coupled to the housing, the depth of the sub-actuator occupies less than one-third of the width of the corresponding one of the at least one cavity.

As another aspect of the disclosed concept, a rocker switch comprises: a housing comprising an exterior, an interior forming at least one cavity, a number of openings each providing access from the exterior to a corresponding one of the at least one cavity, the corresponding one of the at least one cavity including a first side, a second side disposed opposite and distal from the first side, a width between the first side and the second side, and a center disposed between the first side and the second side; a number of lighting elements structured to illuminate a portion of the rocker switch, one of the number of lighting elements being disposed generally in the center of the corresponding one of the at least one cavity of the housing; a number of plungers each being movably coupled to the housing proximate to a corresponding one of the first side of the corresponding one of the at least one cavity and the second side of the corresponding one of the at least one cavity; a number of contact elements; and at least one actuator subassembly comprising: an operating member movably coupled to the housing at or about a corresponding one of the number of openings, the operating member including a longitudinal centerline and at least one projection, the at least one projection being offset with respect to the longitudinal centerline and extending into the corresponding one of the at least one cavity, and a sub-actuator removably coupled to the at least one projection of the operating member, the sub-actuator comprising a shaped portion, a number of contacting portions and a depth, the shaped portion being cooperable with a corresponding one of the number of plungers to provide a plurality of operating characteristics of the operating member, the operating characteristics including a plurality of positions of the operating member, each of the number of contacting portions of the sub-actuator contacting a corresponding one of the number of contact elements when the operating member is disposed in a corresponding one of the plurality of positions. When the at least one actuator subassembly is coupled to the housing, the depth of the sub-actuator occupies less than one-third of the width of the corresponding one of the at least one cavity. When the at least one actuator subassembly is coupled to the housing, the at least one projection of the operating member is disposed beside the lighting element, between the lighting element and the corresponding one of the first side of the corresponding one of the at least one cavity and the second side of the corresponding one of the at least one cavity, and adjacent to the corresponding one of the number of plungers.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the statement that two or more parts are "coupled" together shall mean that the parts are joined together either directly or joined through one or more intermediate parts.

As employed herein, the phrase "operating characteristics" refers to the features of a rocker switch, expressly including, but not limited to, the type of operating member, the count of the number of positions of the operating member, the location of the positions of the operating member, the types of action of the operating member (e.g., without limitation, sustained, momentary and combinations thereof), the operating forces, and the path of movement of the operating member.

As employed herein, the term "contact portion" refers to a segment of the disclosed sub-actuator which is structured to contact or engage and actuate, for example, a switch, as well as to an electrically conductive contactor, such as a conductor, which is either integral with or a separate component coupled to the sub-actuator.

As employed herein, the term "contact element" refers to the element engaged by the aforementioned contact portion. Specifically, this term refers not only to a stationary contact, but also to an electrical actuating mechanism, such as a switch. Switches contemplated by the disclosed concept expressly include, but are not limited to, micro-switches, rubber key pad switches, snap dome switches and tactile switches.

Figure 2:
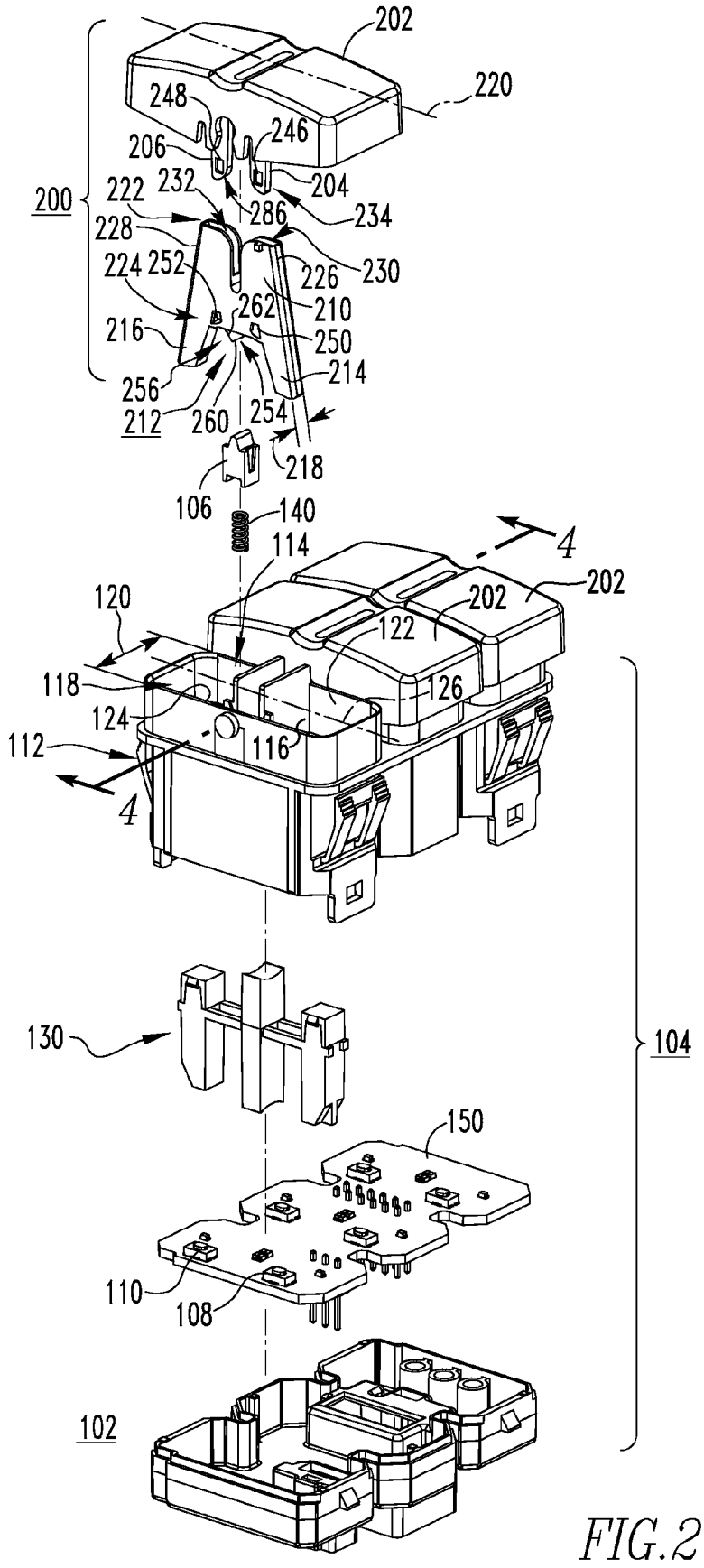
FIG. 2 is an exploded isometric view of a rocker switch and actuator subassembly therefor, in accordance with an embodiment of the disclosed concept.

FIG. 2 shows an actuator subassembly 200 for a rocker switch 102. Among other components, the rocker switch 102 includes a housing 104, a plunger 106 and a number of contact elements 108,110 (two are shown). In the example shown and described herein, the contact elements are first and second tactile switches 108,110 disposed on a printed circuit board 150. However, it will be appreciated that any known or suitable alternative number (see, for example, single contact element 108 of FIG. 8), type and/or configuration could be employed without departing from the scope of the disclosed concept. It will also be appreciated that for economy of disclosure and simplicity of illustration, only one actuator subassembly 200 for the rocker switch 102 will be described in detail, although it will be understood that the rocker switch (e.g., 102) could have a plurality of substantially similar actuator subassemblies (e.g., 102). For example and without limitation, in FIG. 2, the rocker switch 102 has three operating members 202, each of which could have a corresponding actuator subassembly (e.g., 200) therefor.

The rocker switch housing 104 includes an exterior 112 and an interior 114 having at least one cavity 116. For economy of disclosure and simplicity of illustration, only one cavity 116 is described in detail herein, although it will be appreciated that the rocker switch housing 104 could have any suitable number or plurality of cavities (e.g., 116). An opening 118 provides access from the exterior 112 to the cavity 116. The aforementioned plunger 106 is movably coupled to the housing 104 within the cavity 116, as best shown in the section views of FIGS. 4 and 5. The cavity 116 has a width 120, measured by the distance between opposing sides 122,124 of the cavity 116.

Figure 3:
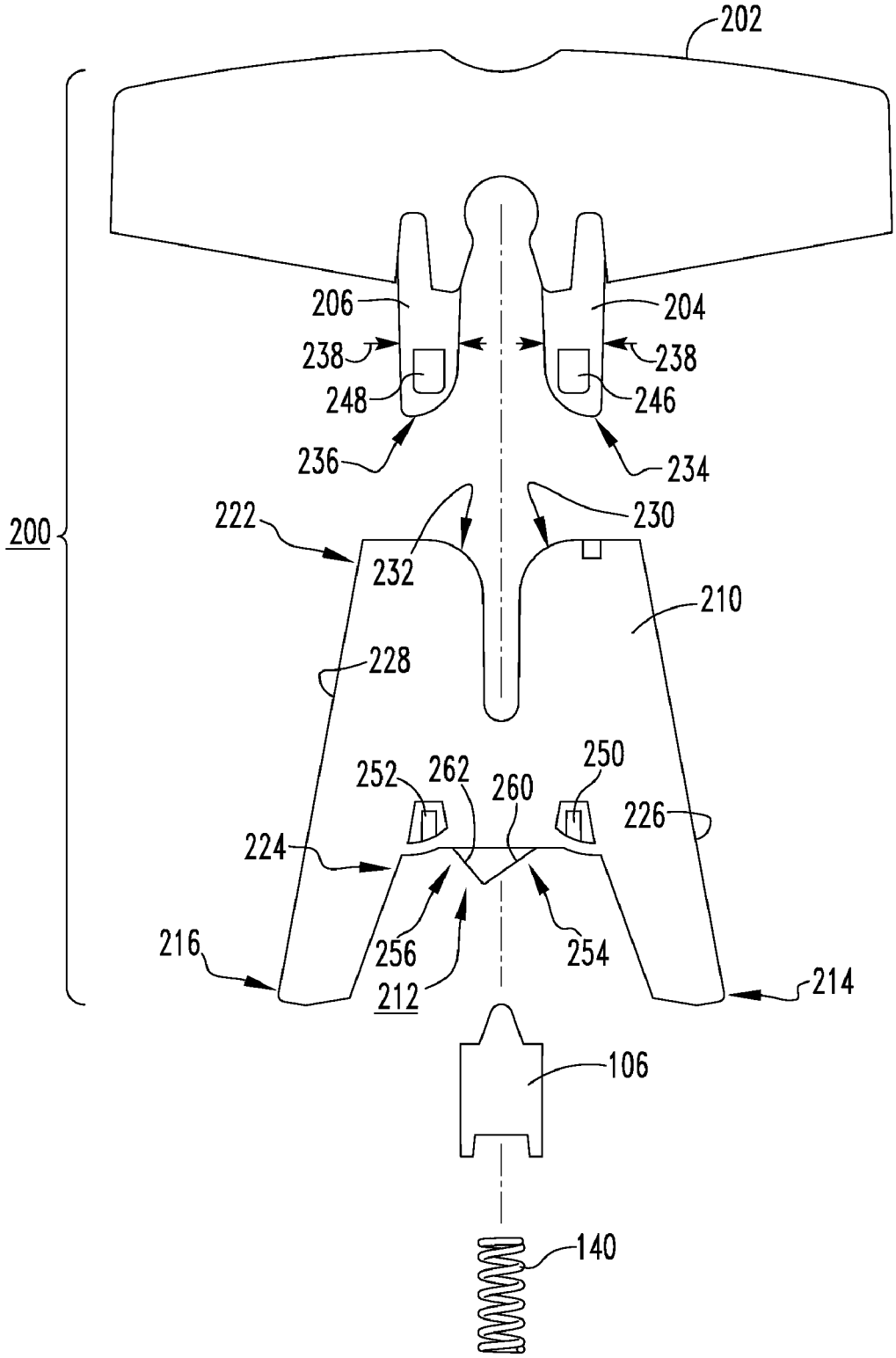
FIG. 3 is an exploded end elevation view of the actuator subassembly of FIG. 2.
Figure 4:
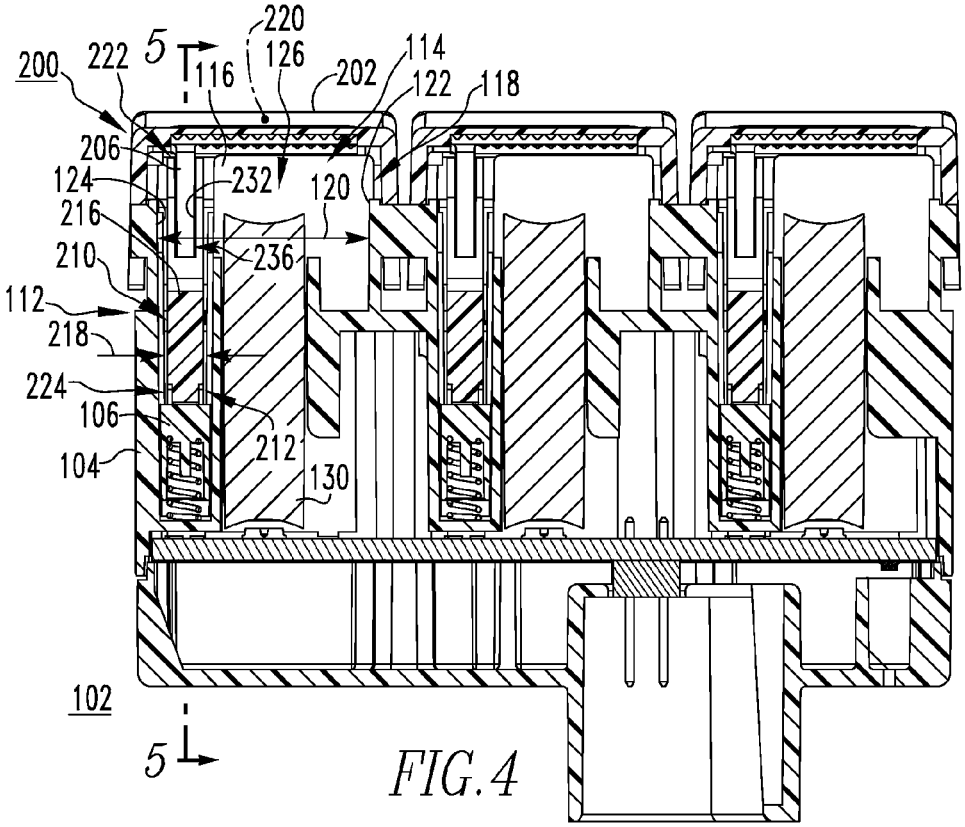
FIG. 4 is a section view along line 4-4 of FIG. 2.
Figure 5:
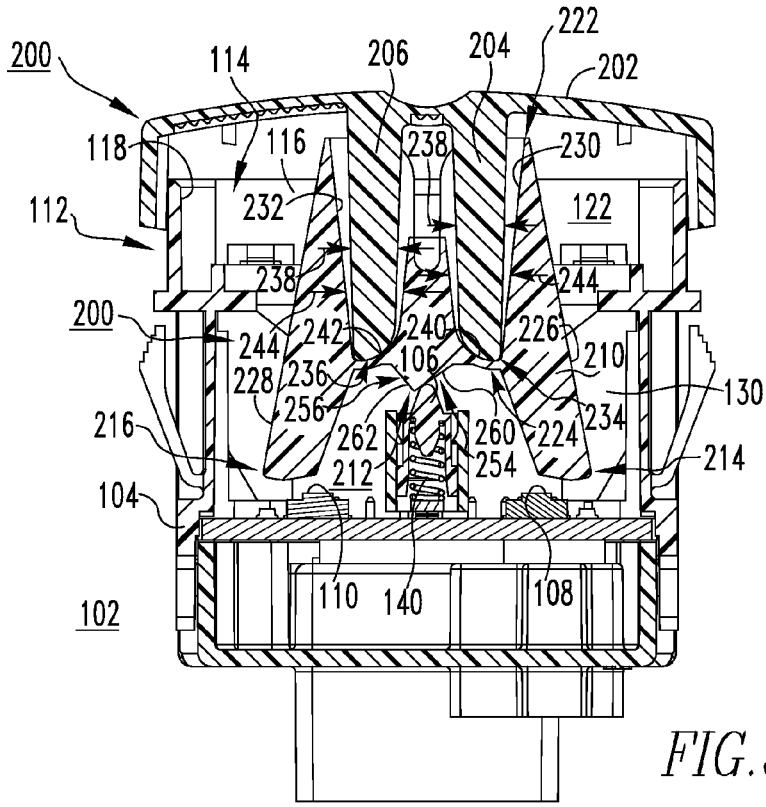
FIG. 5 is a section view taken along line 5-5 of FIG. 4.

Continuing to refer to FIG. 2, and also to FIG. 3, the operating member 202 of the actuator subassembly 200 is removably coupled to the rocker switch housing 104 (FIG. 2) at or about the opening 118 (FIG. 2) thereof. The operating member 202 includes at least one projection, which in the example shown and described herein are a first leg 204 and a second leg 206, that extend outwardly from the operating member 202 into the cavity 116 of the rocker switch housing 104, as shown in FIG. 5. A sub-actuator 210 is removably coupled to the legs 204,206 and is disposed between the operating member 202 and the plunger 106 of the rocker switch 102 (FIGS. 2, 4 and 5). The sub-actuator 210 includes a shaped portion 212, a number of contact portions 214,216 (two are shown) and a depth 218 (FIG. 2). The rocker switch plunger 106 is spring biased by way of a bias element (e.g., without limitation, spring 140) to engage and cooperate with the shaped portion 212 to provide a plurality of operating characteristics of the operating member 202, including a plurality of positions thereof. The contacting portions, which in the example shown and described herein are first and second extensions 214,216, are structured to contact a corresponding one of the contact elements 108,110 (FIGS. 2 and 5), respectively, when the operating member 202 is disposed in a predetermined corresponding one of its positions (described in greater detail hereinbelow with respect to the non-limiting examples of FIGS. 6A-6C, 7A-7C, 8 and 9).

Figure 1:
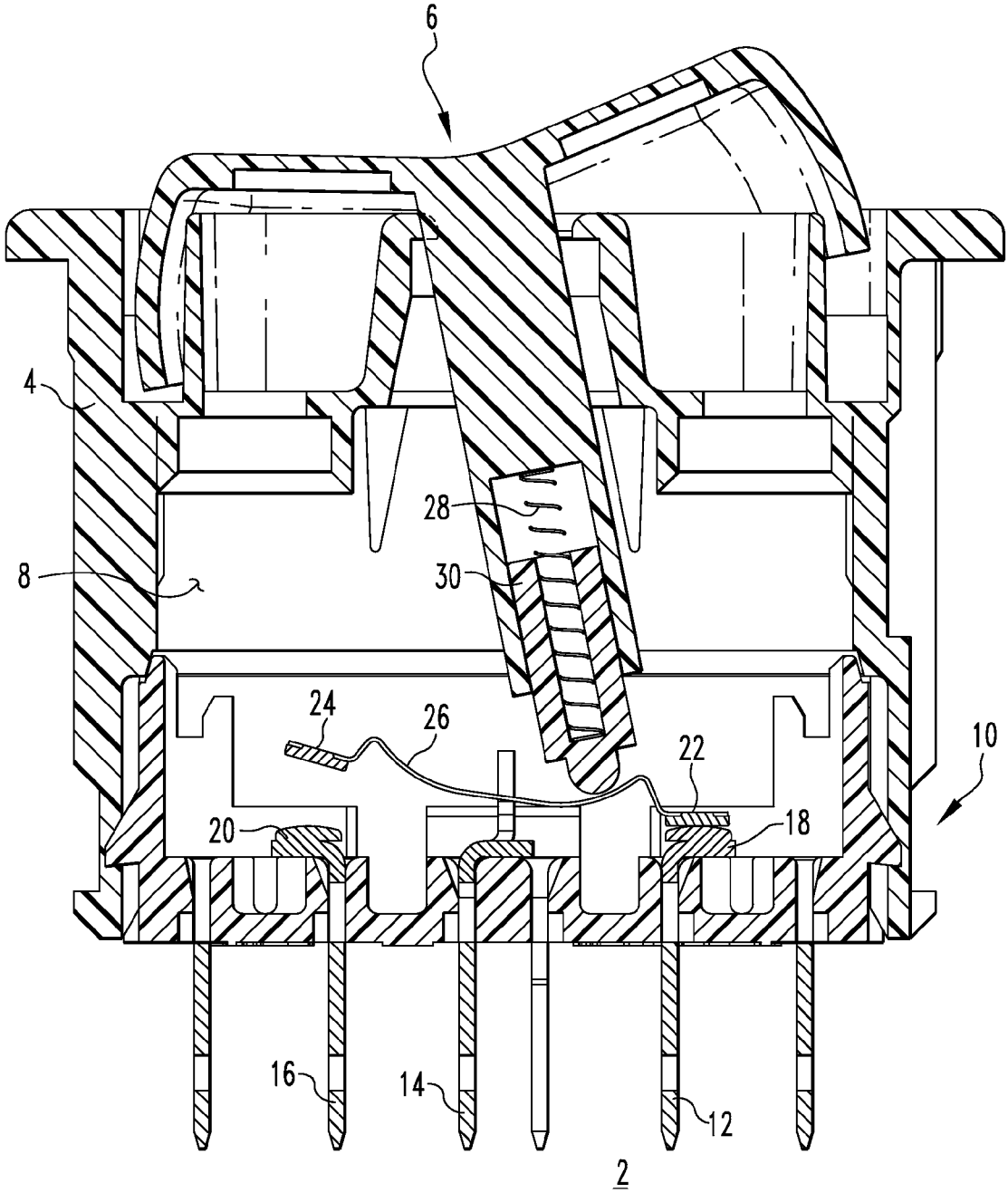
FIG.1 PRIOR ART
FIG. 1 is a side elevation section view of a rocker switch.

Accordingly, not only does the actuator subassembly 200 provide a self-contained unit, which is removably coupled to the rocker switch housing 104 (FIGS. 2, 4 and 5), and which is readily adaptable by interchanging the removable sub-actuator 210 to change the operating characteristics of the rocker switch 102 (FIGS. 2, 4 and 5), but it is also designed to occupy relatively little space within the cavity 116 (FIGS. 2, 4 and 5) of the rocker switch housing 104 (FIGS. 2, 4 and 5). More specifically, when the actuator subassembly 200 is coupled to the housing 104, as shown in FIGS. 4 and 5, the depth 218 of the sub-actuator 210 preferably occupies less than one-third of the width 120 of the housing cavity 116, as best shown in FIG. 4. Among other advantages, this enables a suitable lighting element such as, for example and without limitation, the light pipe 130 shown in the exploded view of FIG. 2, to be disposed in or about the center 126 of the housing cavity 116, as shown in FIG. 4. In other words, the light pipe 130 could alternatively be disposed at a suitable location (not shown) in which it is shifted (e.g., without limitation, up to 17 percent of the cavity width 120 to the right from the perspective of FIG. 4) within the cavity 116 from the position shown in FIG. 4, without departing from the scope of the invention. Thus, the entire operating member 202 can be effectively illuminated, for example, to improve user identification of the rocker switch 102 and/or any labels (e.g., without limitation "ON", "OFF", or other suitable numbering, lettering or identification) of the operating member 202. Such a centralized location of the lighting element 130 was not available with known prior rocker switch designs (see, for example, rocker switch 2 of FIG. 1) wherein the operating member (see, for example, operating member 6 of rocker switch 2 of FIG. 1) extended downwardly into the center of the cavity (see, for example, cavity 8 of FIG. 1) and occupied relatively substantial space.

More specifically, as shown in FIGS. 2 and 4, the operating member 202 of the example actuator subassembly 200 includes a longitudinal centerline 220. The legs 204,206, which extend outwardly from the operating member 202 into the cavity 216, are laterally offset with respect to the longitudinal centerline 220, as best shown in FIG. 4. Thus, when the actuator subassembly 200 is coupled to the housing 104 of the rocker switch 102, as shown in FIG. 4, the legs 204,206 (both shown in FIG. 2; only leg 206 is show in FIG. 4) are disposed proximate to the corresponding side 124 of the housing cavity 116, rather than in the center 126 (designated by reference line 126 in FIG. 2; see also FIG. 4), as in known rocker switch designs (see, for example, rocker switch 2 of FIG. 1). The corresponding rocker switch plunger 106 is also disposed proximate to the same side 124 of the cavity 116, adjacent to the sub-actuator 210, such that it can suitably cooperate with the shaped portion 212 thereof. For example and without limitation, in the example of FIG. 4, the plunger 106 is disposed to the left (from the perspective of FIG. 4) within the cavity 116, and below (from the perspective of FIG. 4) leg 206 and sub-actuator 210. This enables the aforementioned lighting element 130 to be disposed generally in the center 126 of the cavity 116, such that the longitudinal centerline 220 of the operating member 202 overlays the lighting element 130, as shown. Accordingly, the leg 206 is disposed beside the lighting element 130 between the lighting element 130 and the corresponding side 124 of the cavity 116.

In addition to being advantageously relatively thin, as previously discussed, the disclosed actuator subassembly 200 (see also the non-limiting example actuator subassemblies 200',200",200'",200"" of FIGS. 6A-6C, 7A-7C, 8 and 9, respectively), is also robust. That is, by virtue of its two-piece design, wherein the sub-actuator 210 is removably coupled to the legs 204,206 (both shown in FIGS. 2, 3 and 5) of the operating member 202, the actuator subassembly 200 is resistant to unintentional disassembly or breaking apart, for example, due to being dropped. The manner in which the sub-actuator 210 is removably coupled to the operating member 202 and, in particular, the first and second legs 204,206 thereof, will now be described in greater detail. Specifically, the sub-actuator 210 includes a first slot 230 and a second slot 232, which receive the first leg 204 and second leg 206, respectively, as best shown in the sectional view of FIG. 5. The slots 230,232 extend from the first end 222 of the sub-actuator 210 toward the second end 224 of the sub-actuator 210 between the first and second edges 226,228 of the sub-actuator 210. The first and second legs 204,206 include first and second apertures 246,248, as shown in FIGS. 2 and 3, and the sub-actuator 210 includes first and second resilient tabs 250,252, which extend into the first and second slots 230,232, respectively, of the sub-actuator 210. Accordingly, when the sub-actuator 210 is pivotably and removably coupled to the operating member 202, the first resilient tab 250 is disposed in the first aperture 246 of the first leg 204, and the second tab 252 is disposed in the second aperture 248 of the second leg 206. It will, however, be appreciated that any known or suitable alternative securing mechanism (not shown) could be employed in any known or suitable alternative number and/or configuration to suitably secure the sub-actuator 210 to the operating member 202, in accordance with the disclosed concept. When the operating member 202 and sub-actuator 210 are coupled together, they collectively form the disclosed actuator subassembly 200, which is a self-contained unit that is removable from the remainder of the rocker switch 102 (FIGS. 2, 4 and 5), so that the sub-actuator 210 may be replaced with another, different sub-actuator (see, for example, sub-actuators 210' of FIGS. 6A-6C, 210" of FIGS. 7A-7C, 210'" of FIG. 8 and 210"" of FIG. 9, respectively), to change the operating characteristics of the rocker switch 102, as described in greater detail hereinbelow.

As shown in FIG. 5, it will be appreciated that the first and second legs 204,206 of the operating member 202 of the example actuator subassembly 200 each have a leg width 238. The first and second slots 230,232 in which the legs 204,206 are respectively disposed, each have a slot width 244. The slot width 244 is greater than the leg width 238, as shown, thereby enabling the sub-actuator to pivot both with, and with respect to, the operating member 202. In particular, each leg 204,206 has an end 234,236, and each slot 230,232 has a corresponding base 240,242, respectively. The end 234 of first leg 204 pivotably cooperates with the base 240 of the first slot 230, and the end 236 of the second leg 206 pivotably cooperates with the base 242 of the second slot 232. In this manner, the disclosed actuator subassembly 200 is capable of accommodating dimensional tolerance variations, which may be present among the components (e.g., without limitation, operating member legs 204,206; housing 104; cavity 116; sides 122,124 (both shown in FIG. 4)) of the rocker switch 102. It also enables the operating member 202 to pivot to a desired position with respect to a wide variety of different rocker switch housings (e.g., 104), to ensure that the contact elements (e.g., without limitation, tactile switches 108,110) will be efficiently and effectively engaged and actuated, when the operating member 202 is moved to the desired predetermined position (see, for example and without limitation, the actuated positions of operating member 202' of FIGS. 6B and 6C; see also the actuated positions of operating member 202" of FIGS. 7B and 7C).

The shaped portion 212 of the sub-actuator 210 is disposed at or about the second end 224 of the sub-actuator 210 between the first and second edges 226,228 thereof. The shaped portion 212 includes at least two shaped sections 254,256 (two are shown in the example of FIGS. 2, 3 and 5) each having a profile 260,262. The profiles 260,262 are engaged by the spring-biased plunger 106 of the rocker switch 102, and it is the interaction between the plunger 106 and the profile 260,262 that dictates the operating characteristics associated with each of the positions of the rocker switch operating member 202. This will be further appreciated with reference to the following EXAMPLES, which will now be discussed with reference to FIGS. 5, 6A-6C, 7A-7C, 8 and 9. It will, however, be appreciated that the following EXAMPLES are provided for purposes of illustration only and represent merely some of the numerous actuator subassembly embodiments that are possible in accordance with the disclosed concept. Accordingly, the following EXAMPLES are not meant to be limiting upon the scope of the disclosed concept in any way. It will further be appreciated that similar components in each embodiment are numbered similarly. However, for economy of disclosure, not every component will be repetitively described. For example in the embodiment of FIG. 5, the actuator subassembly is numbered 200, whereas in the embodiment of FIGS. 6A-6C it is numbered 200', in the embodiment of FIGS. 7A-7C it is numbered 200", in the embodiment of FIG. 8 it is numbered 200'" and in the embodiment of FIG. 9 it is numbered 200"".

Example 1

The rocker switch 102 of FIG. 5 includes an actuator subassembly 200, wherein the sub-actuator 210 has a shaped portion 212 with two shaped segments 254,256 each having a profile 260,262, respectively, as shown. Such profiles 260, 262 are engaged by the spring biased plunger 106 of the rocker switch 102 to provide the operating member 202 with two positions. Specifically, the operating member 202 has a neutral or unactuated position (shown), in which neither of the tactile switches 108,110 are engaged by the corresponding extensions 214,216 of the sub-actuator 210. This position is a maintained position. That is, the operating member 202 will remain in the position shown in FIG. 5 unless and until it is engaged and moved by an outside force (e.g., without limitation, an actuation by an end user). This first maintained position is provided by way of the first profile 260 and, in particular, by way of the forces that are exerted on the first profile 260 and, in turn, on the sub-actuator 210 and operating member 202, by the spring-biased plunger 106. In addition, the second profile 262 provides a second maintained position in which the operating member 202 is pivoted (e.g., to the left or counterclockwise from the perspective of FIG. 5), for example, to the position generally shown in FIG. 6B. In that position, the second extension of the sub-actuator 210 will engage and actuate the second tactile switch 110 (not shown in FIG. 5, but see, for example, the second tactile switch 110 actuated by second extension 216' in FIG. 6B).

Example 2

Figure 6A:
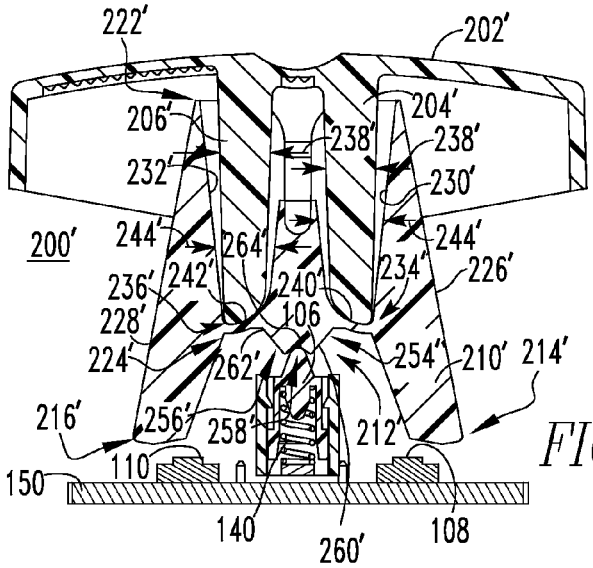
FIGS. 6A, 6B and 6C are section views each showing a position of the actuator subassembly for a respective three-position rocker switch, wherein the rocker switch is structured to provide three sustained actions in accordance with an embodiment of the disclosed concept.
Figure 6B:
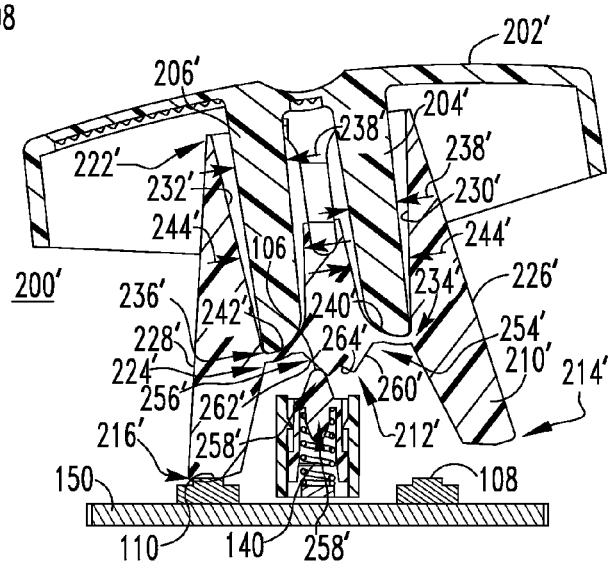
Figure 6C:
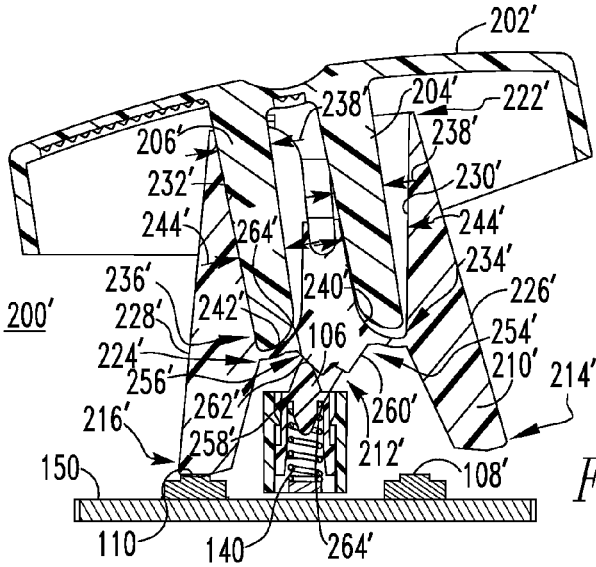

FIGS. 6A-6C illustrate another actuator subassembly 200' in which the sub-actuator 210' has a shaped portion 212' including three shaped segments 254',256',258' and three profiles 260',262',264', respectively, therefor. Except for the different sub-actuator 210', the remainder of the actuator subassembly 200' is substantially the same as actuator subassembly 200 previously discussed hereinabove with respect to FIGS. 2-5.

The shaped portion 212' and, in particular, the interaction between the plunger 106 and the three profiles 260',262',264', provide the operating member 202' with three maintained positions. The first, or unactuated, maintained position is shown in FIG. 6A, wherein the plunger 106 engages the concave profile 264' in the center of the shaped portion 212' of the sub-actuator 210', as shown. In this position, neither of the extensions 214',216' of the sub-actuator 210' engages its corresponding contact element 108,110, respectively, on the printed circuit board 150 of the rocker switch 102 (FIGS. 2, 4 and 5). This position will be maintained until, for example, the operating member 202' is pivoted (e.g., to the left or counterclockwise from the perspective of FIG. 6A) to the position shown in FIG. 6B.

FIG. 6B shows a second maintained position, in which the plunger 106 engages the second profile 262' of the corresponding shaped segment 236' of the shaped portion 212' of the sub-actuator 210. In response, the plunger 106 pushes on the profile 262' to maintain the second extension 216' of the sub-actuator 210' in engagement with the second contact element 110 of the printed circuit board 150, as shown.

The third maintained position of the actuator subassembly 200' of FIGS. 6A-6C is not shown, but it will be appreciated that it is a mirror image of the position shown in FIG. 6B. That is, the first extension 214' of the sub-actuator 210' would be held in actuating engagement with the first contact element 108 of the printed circuit board 150 by the interaction of the spring-biased plunger 106 on the first profile 260' of the first shaped segment 254'.

FIG. 6C illustrates the aforementioned unique capability of the disclosed actuator subassembly (e.g., without limitation, 200') to accommodate dimensional tolerance variations. For example, as shown in FIG. 6C, the operating member 202' can continue to pivot (e.g., to the left or counterclockwise from the perspective of FIG. 6C) from the position shown in FIG. 6B, if necessary, to ensure that the corresponding contact element 110 is effectively actuated. In other words, the slot width 244' of the first and second slots 230',232' of the sub-actuator 210' being larger than the leg width 238' of the first and second legs 204',206' of the operating member 202', allows the operating member 202' to pivot both with, and with respect to, the sub-actuator 210'. In this manner, it can be assured that the operating member 202' will achieve the necessary degree of movement (e.g., pivot) to achieve the desired position and corresponding actuation of the corresponding actuating element (e.g., 110) of the rocker switch 102 (FIGS. 2, 4 and 5). This is because the contact element (e.g., 110) is engaged and actuated by the corresponding extension (e.g., 216' of the sub-actuator 210', at the position shown in FIG. 6B, before the operating member 202' and sub-actuator 210' achieve their full range movement to the position shown in FIG. 6C.

Example 3

Figure 7A:
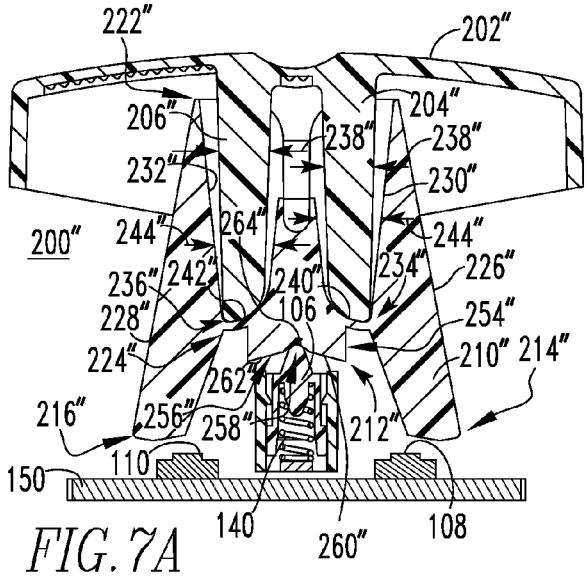
FIGS. 7A, 7B and 7C are section views each showing a position of the actuator subassembly for a respective three-position rocker switch, wherein the rocker switch is structured to provide first and second momentary actions and a sustained action in accordance with another embodiment of the disclosed concept.
Figure 7B:
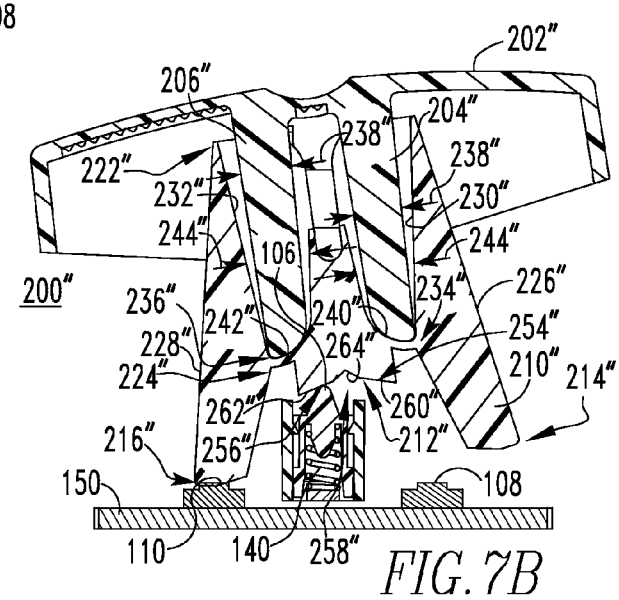
Figure 7C:
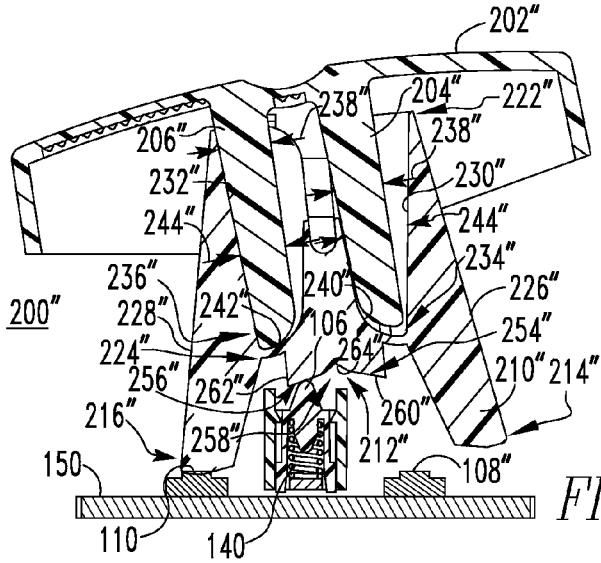

FIGS. 7A-7C show another non-limiting embodiment of an actuator subassembly 200" wherein the operating member 202' thereof has three positions. Specifically, as shown in FIG. 7A, the operating member 202" has an unactuated or first maintained position in which neither of the rocker switch contact elements 108,110 is engaged or actuated by a corresponding extension 214",216" of the sub-actuator 210". This position is dictated by the plunger 106 being biased against the concave profile 264" of the third shaped segment 258" of the shaped portion 212" of the sub-actuator 210".

The other two positions (one of which is shown in FIG. 7B) of the operating member 202" are momentary positions, in which the operating member 202" must be moved (e.g., pivoted to the left or counterclockwise from the perspective of FIG. 7B) and held in to be maintained, otherwise the operating member 202" will return to the position of FIG. 7A. In the position of FIG. 7B, the extension 216" engages and actuates the corresponding contact element 110 of the printed circuit board 150. More specifically, by virtue of the sloped profile 262" of the second shaped segment 256", the plunger 106 will slide back into the first position shown in FIG. 7A, unless the operating member 202" is held in the position shown in FIG. 7B. It will be appreciated that the third position (not shown), which is also a momentary position, is essentially a mirror image of the position of FIG. 7B and, therefore, has not been shown or described in detail herein for economy of disclosure.

Similar to FIG. 6C previously discussed hereinabove with respect to actuator subassembly 202', FIG. 7C shows the unique capability of the sub-actuator 210" to pivot both with, and with respect to, the operating member 202" to ensure that the desired contact element actuation and/or position of the operating member 202" is/are achieved, regardless of whether or not various dimensional tolerance variations exist among the components of the rocker switch 102 (FIGS. 2, 4 and 5). In this manner, it can be assured that the actuator subassembly (e.g., 200") will operate properly with a wide variety of different rocker switches (e.g., 102 (FIGS. 2, 4 and 5)).

Example 4

Figure 8:
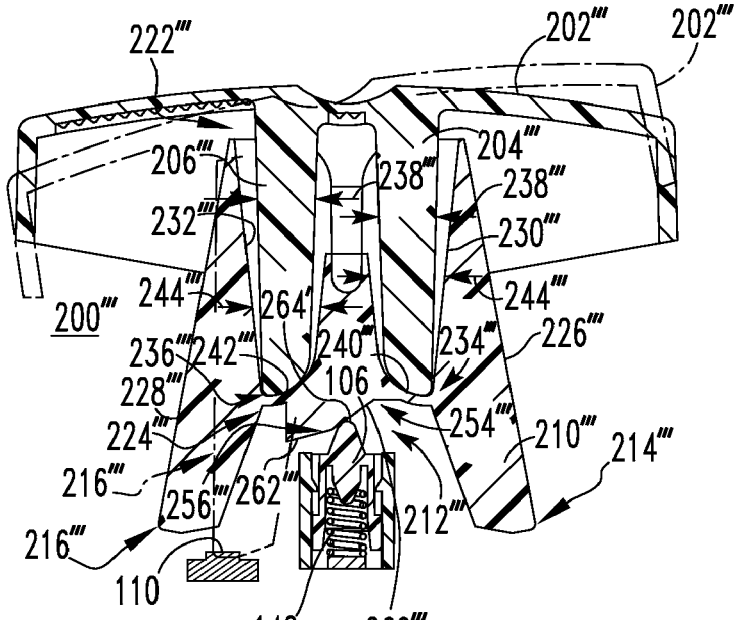
FIGS. 8 and 9 are section views of two-position rocker switches, and actuator subassemblies therefor, in accordance with embodiments of the disclosed concept.

FIG. 8 shows an actuator subassembly 202'" in which the shaped portion 212'" of the sub-actuator 210'" includes two shaped segments 256'",258'" having profiles 260'",262'", respectively. The rocker switch plunger 106 cooperates with (e.g., is biased against) the first profile 260'" to provide the unactuated maintained position shown in solid line drawing in FIG. 8. The second profile 262'" enables the operating member 202'" to be actuated (e.g., pivoted to the left or counterclockwise from the perspective of FIG. 8) to the position shown in phantom line drawing in FIG. 8. In the momentary actuated position, shown in phantom line drawing, the second extension 216'" of the sub-actuator 210'" engages and actuates contact element 110.

FIG. 8 illustrates a non-limiting example in which the actuator subassembly 200'" is employed with only one actuating element 110. For example, because the operating member 202'" in the example of FIG. 8 only has two positions, the first extension 214'" of the sub-actuator 210'" is not required to cooperate with a contacting element 110 (FIGS. 2, 4, 5, 6A-6C, 7A-7C and 9) of the rocker switch 102 (FIGS. 2, 4 and 5).

Example 5

Figure 9:
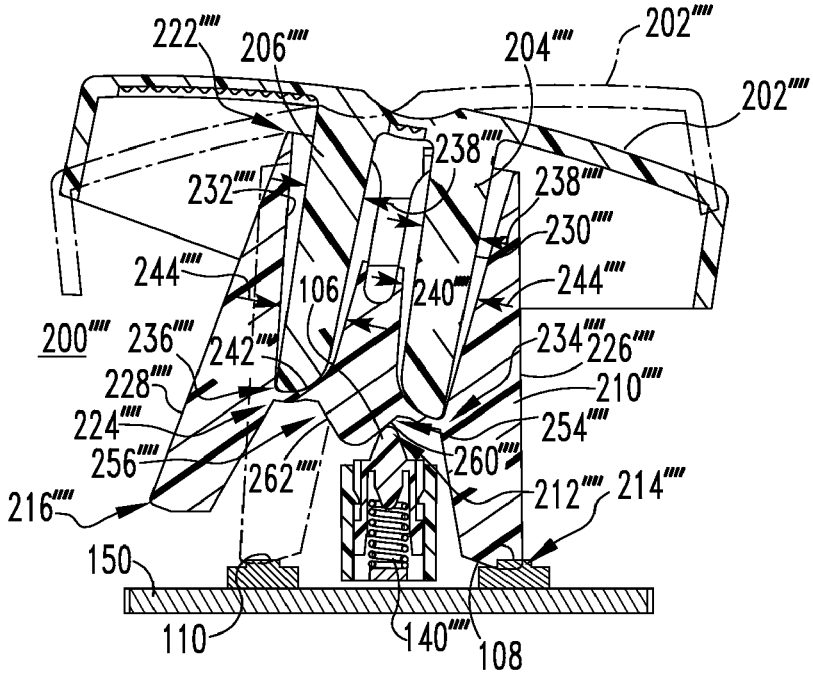

FIG. 9 shows an actuator subassembly 200"" in which the shaped portion 212"" of the sub-actuator 210"" includes two shaped segments 254"",256"" having profiles 260"",262"", respectively. The profiles 260"",262"" cooperate with the plunger 106 to provide the operating member 202"" with two maintained positions. In the first maintained position, which is shown in solid line drawing in the example of FIG. 9, the plunger 106 biases against the first profile 260"" to bias the operating member 202"" until the first extension 214"" of the sub-actuator 210"" engages and actuates the first contact element 108 of the printed circuit board 150. The shape of the profile 260"" also enables the plunger 106 to hold the sub-actuator 210"" and operating member 202"" in the position shown in solid line drawing.

The second position is a mirror image position in which the operating member 202"" is tilted (e.g., without limitation, to the left or counterclockwise from the perspective of FIG. 9) by the interaction of the plunger 106 on the second profile 262"" which, in turn, biases the second extension 216"" of the sub-actuator 210"" to engage and actuate the second contact element 110 of the printed circuit board 150, as shown in phantom line drawing in FIG. 9.

In view of the foregoing EXAMPLES, it will be appreciated that the disclosed actuator subassembly 200 (FIGS. 2-5), 200' (FIGS. 6A-6C), 200" (FIGS. 7A-7C), 200'" (FIG. 8), 200"" (FIG. 9), provides a unique removable self-contained unit, wherein sub-actuators 210 (FIGS. 2-5), 210' (FIGS. 6A-6C), 210" (FIGS. 7A-7C), 210'" (FIG. 8), 210"" (FIG. 9) having a wide variety of different shapes and/or configurations can be interchanged to modify the operating characteristics of the rocker switch operating member 202 (FIGS. 2-5), 202' (FIGS. 6A-6C), 202" (FIGS. 7A-7C), 202'" (FIG. 8), 202"" (FIG. 9), relatively quickly and easily. The actuator subassembly 200 (FIGS. 2-5), 200' (FIGS. 6A-6C), 200" (FIGS. 7A-7C), 200'" (FIG. 8), 200"" (FIG. 9) is also robust in design and is capable of accommodating dimensional tolerance variations among various components of the rocker switch 102 (FIGS. 2, 4 and 5). Additionally, the sub-actuator 210 (FIGS. 2-5), 210' (FIGS. 6A-6C), 210" (FIGS. 7A-7C), 210'" (FIG. 8), 210"" (FIG. 9) of the actuator subassembly 200 (FIGS. 2-5), 200' (FIGS. 6A-6C), 200" (FIGS. 7A-7C), 200'" (FIG. 8), 200"" (FIG. 9), is relatively small (e.g., thin) and is offset with respect to the center 126 (FIGS. 2 and 4) of the housing cavity 116 (FIGS. 2, 4 and 5), in order that a lighting element 130 (FIGS. 2, 4 and 5) can be essentially disposed within the cavity 116 (FIGS. 2, 4 and 5) to effectively illuminate the entire operating member 202 (FIGS. 2-5), 202' (FIGS. 6A-6C), 202" (FIGS. 7A-7C), 202'" (FIG. 8), 202"" (FIG. 9).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An actuator subassembly for a rocker switch, said rocker switch comprising a housing, a plunger and a number of contact elements, the housing including an exterior, an interior having a cavity, and an opening providing access from the exterior to said cavity, said plunger being movably coupled to said housing within said cavity, said cavity having a width, said actuator subassembly comprising:

an operating member structured to be movably coupled to the housing of said rocker switch at or about said opening, said operating member including at least one projection structured to extend into said cavity of the housing; and a sub-actuator structured to be removably coupled to said at least one projection of said operating member between said operating member and said plunger of said rocker switch, said sub-actuator comprising a shaped portion, a number of contacting portions and a depth, the shaped portion being structured to cooperate with said plunger to provide a plurality of operating characteristics of said operating member, said operating characteristics including a plurality of positions of said operating member, each of the number of contacting portions being structured to contact a corresponding one of said number of contact elements of said rocker switch when said operating member is disposed in a corresponding one of said plurality of positions, wherein, when said actuator subassembly is coupled to the housing of said rocker switch, the depth of said sub-actuator is structured to occupy less than one-third of the width of said cavity of the housing.

2. The actuator subassembly of claim 1 wherein said cavity of the housing of said rocker switch has a first side, a second side disposed opposite and distal from the first side, and a center disposed between the first side and the second side; wherein the width of said cavity is defined by the distance between the first side and the second side; wherein said operating member includes a longitudinal centerline; wherein said at least one projection of said operating member is offset with respect to said longitudinal centerline; and wherein, when said actuator subassembly is coupled to the housing of said rocker switch, said at least one projection is structured to be disposed proximate to a corresponding one of the first side of said cavity and the second side of said cavity.

3. The actuator subassembly of claim 2 wherein said rocker switch further comprises a lighting element structured to illuminate said operating member; wherein said lighting element is disposed generally in the center of said cavity; and wherein said longitudinal centerline of said operating member is structured to overlay said lighting element in order that said at least one projection is disposed beside said lighting element, between said lighting element and said corresponding one of the first side of said cavity and the second side of said cavity.

4. The actuator subassembly of claim 1 wherein said sub-actuator further comprises a first end, a second end, a first edge, a second edge and at least one recess; wherein said at least one recess extends inwardly from the first end of said sub-actuator toward the second end of said sub-actuator between the first edge of said sub-actuator and the second edge of said sub-actuator; and wherein said at least one projection of said operating member is pivotably disposed within said at least one recess.

5. The actuator subassembly of claim 4 wherein said at least one projection of said operating member is a first leg and a second leg; wherein said at least one recess of said sub-actuator includes a first slot and a second slot; wherein the first leg of said operating member is disposed in the first slot of said sub-actuator; and wherein the second leg of said operating member is disposed in the second slot of said sub-actuator.

6. The actuator subassembly of claim 5 wherein each of the first leg and the second leg comprises an end and a leg width; wherein each of the first slot and the second slot comprises a base and a slot width; wherein the end of the first leg pivotably engages the base of the first slot; wherein the end of the second leg pivotably engages the base of the second slot; and wherein the leg width is less than the slot width in order that said sub-actuator is pivotable with respect to said operating member.

7. The actuator subassembly of claim 5 wherein the first leg of said operating member includes a first aperture; wherein the second leg of said operating member includes a second aperture; wherein said sub-actuator further comprises a first resilient tab and a second resilient tab; wherein the first resilient tab extends into the first slot of said sub-actuator; wherein the second resilient tab extends into the second slot of said sub-actuator; and wherein, when said sub-actuator is pivotably coupled to said operating member, the first resilient tab is disposed in the first aperture of the first leg and the second resilient tab is disposed in the second aperture of the second leg.

8. The actuator subassembly of claim 4 wherein the shaped portion of said sub-actuator is disposed at or about the second end of said sub-actuator, between the first edge of said sub-actuator and the second edge of said sub-actuator; wherein the shaped portion includes at least two shaped sections each having a profile; wherein said profile is structured to be engaged by the plunger of said rocker switch; and wherein the interaction between said plunger and said profile is structured to dictate the operating characteristics associated with said corresponding one of said plurality of positions of said operating member.

9. The actuator subassembly of claim 4 wherein said number of contact elements of said rocker switch is a plurality of contact elements; wherein said plurality of positions of said operating member comprise a first position and a second position; wherein the contact portion of said sub-actuator comprises a first extension and a second extension; wherein the first extension extends outwardly from the second end of said sub-actuator at or about the first edge of said sub-actuator; wherein the second extension extends outwardly from the second end of said sub-actuator at or about the second edge of said sub-actuator generally opposite the first extension; wherein, when said operating member is disposed in said first position, the first extension is structured to contact a corresponding first one of said plurality of contact elements of said rocker switch; and wherein, when said operating member is disposed in said second position, the second extension is structured to contact a corresponding second one of said plurality of said plurality of contact elements of said rocker switch.

10. The actuator subassembly of claim 9 wherein said plurality of contact elements of said rocker switch are a first tactile switch and a second tactile switch; wherein, when said operating member is disposed in said first position, the first extension of said sub-actuator is structured to engage and actuate said first tactile switch; and wherein, when said operating member is disposed in said second position, the second extension of said sub-actuator is structured to engage and actuate said second tactile switch.

11. A rocker switch comprising:

a housing comprising an exterior, an interior forming at least one cavity having a width, and a number of openings each providing access from the exterior to a corresponding one of said at least one cavity;

a number of plungers each being movably coupled to the housing within said corresponding one of said at least one cavity;

a number of contact elements; and at least one actuator subassembly comprising:

an operating member movably coupled to the housing at or about a corresponding one of said number of openings, said operating member including at least one projection extending into said corresponding one of said at least one cavity, and a sub-actuator removably coupled to said at least one projection of said operating member, said sub-actuator comprising a shaped portion, a number of contacting portions and a depth, the shaped portion being cooperable with a corresponding one of said number of plungers to provide a plurality of operating characteristics of said operating member, said operating characteristics including a plurality of positions of said operating member, each of the number of contacting portions of said sub-actuator contacting a corresponding one of said number of contact elements when said operating member is disposed in a corresponding one of said plurality of positions, wherein, when said at least one actuator subassembly is coupled to the housing, the depth of said sub-actuator occupies less than one-third of the width of said corresponding one of said at least one cavity.

12. The rocker switch of claim 11 wherein said corresponding one of said at least one cavity has a first side, a second side disposed opposite and distal from the first side, and a center disposed between the first side and the second side; wherein said corresponding one of said number of plungers is coupled to the housing proximate to a corresponding one of the first side of said corresponding one of said at least one cavity and the second side of said corresponding one of said at least one cavity; wherein said operating member includes a longitudinal centerline; wherein said at least one projection of said operating member is offset with respect to said longitudinal centerline; and wherein, when said at least one actuator subassembly is coupled to the housing, said at least one projection is disposed proximate to said corresponding one of the first side of said corresponding one of said at least one cavity and the second side of said corresponding one of said at least one cavity, between said operating member and said corresponding one of said number of plungers.

13. The rocker switch of claim 12 wherein the housing further comprises a number of lighting elements structured to illuminate said operating member; wherein one of said number of lighting elements is disposed generally in the center of said corresponding one of said at least one cavity of the housing; and wherein said longitudinal centerline of said operating member overlays said lighting element in order that said at least one projection is disposed beside said lighting element, between said lighting element and said corresponding one of the first side of said corresponding one of said at least one cavity and the second side of said corresponding one of said at least one cavity.

14. The rocker switch of claim 11 wherein said sub-actuator further comprises a first end, a second end, a first edge, a second edge and at least one recess; wherein said at least one recess extends inwardly from the first end of said sub-actuator toward the second end of said sub-actuator between the first edge of said sub-actuator and the second edge of said sub-actuator; and wherein said at least one projection of said operating member is pivotably disposed within said at least one recess.

15. The rocker switch of claim 14 wherein said at least one projection of said operating member is a first leg and a second leg; wherein said at least one recess of said sub-actuator includes a first slot and a second slot; wherein the first leg of said operating member is disposed in the first slot of said sub-actuator; and wherein the second leg of said operating member is disposed in the second slot of said sub-actuator.

16. The rocker switch of claim 15 wherein each of the first leg and the second leg comprises an end and a leg width; wherein each of the first slot and the second slot comprises a base and a slot width; wherein the end of the first leg pivotably engages the base of the first slot; wherein the end of the second leg pivotably engages the base of the second slot; and wherein the leg width is less than the slot width in order that said sub-actuator is pivotable with respect to said operating member.

17. The rocker switch of claim 15 wherein the first leg of said operating member includes a first aperture; wherein the second leg of said operating member includes a second aperture; wherein said sub-actuator further comprises a first resilient tab and a second resilient tab; wherein the first resilient tab extends into the first slot of said sub-actuator; wherein the second resilient tab extends into the second slot of said sub-actuator; and wherein, when said sub-actuator is pivotably coupled to said operating member, the first resilient tab is disposed in the first aperture of the first leg and the second resilient tab is disposed in the second aperture of the second leg.

18. The rocker switch of claim 14 wherein the shaped portion of said sub-actuator is disposed at or about the second end of said sub-actuator, between the first edge of said sub-actuator and the second edge of said sub-actuator; wherein the shaped portion includes at least two shaped sections each having a profile; and wherein said profile is engaged by said corresponding one of said number of plungers to dictate the operating characteristics associated with said corresponding one of said plurality of positions of said operating member.

19. The rocker switch of claim 14 wherein said number of contact elements are a first contact element and a second contact element; wherein said plurality of positions of said operating member comprise a first position and a second position; wherein the contact portion of said sub-actuator comprises a first extension and a second extension; wherein the first extension extends outwardly from the second end of said sub-actuator at or about the first edge of said sub-actuator; wherein the second extension extends outwardly from the second end of said sub-actuator at or about the second edge of said sub-actuator generally opposite the first extension; wherein, when said operating member is disposed in said first position, the first extension contacts said first contact element; and wherein, when said operating member is disposed in said second position, the second extension contacts said second contact element.

20. A rocker switch comprising:

a housing comprising an exterior, an interior forming at least one cavity, a number of openings each providing access from the exterior to a corresponding one of said at least one cavity, said corresponding one of said at least one cavity including a first side, a second side disposed opposite and distal from the first side, a width between the first side and the second side, and a center disposed between the first side and the second side;

a number of lighting elements structured to illuminate a portion of said rocker switch, one of said number of lighting elements being disposed generally in the center of said corresponding one of said at least one cavity of the housing;

a number of plungers each being movably coupled to the housing proximate to a corresponding one of the first side of said corresponding one of said at least one cavity and the second side of said corresponding one of said at least one cavity;

a number of contact elements; and at least one actuator subassembly comprising:

an operating member movably coupled to the housing at or about a corresponding one of said number of openings, said operating member including a longitudinal centerline and at least one projection, said at least one projection being offset with respect to said longitudinal centerline and extending into said corresponding one of said at least one cavity, and a sub-actuator removably coupled to said at least one projection of said operating member, said sub-actuator comprising a shaped portion, a number of contacting portions and a depth, the shaped portion being cooperable with a corresponding one of said number of plungers to provide a plurality of operating characteristics of said operating member, said operating characteristics including a plurality of positions of said operating member, each of the number of contacting portions of said sub-actuator contacting a corresponding one of said number of contact elements when said operating member is disposed in a corresponding one of said plurality of positions, wherein, when said at least one actuator subassembly is coupled to the housing, the depth of said sub-actuator occupies less than one-third of the width of said corresponding one of said at least one cavity, and wherein, when said at least one actuator subassembly is coupled to the housing, said at least one projection of said operating member is disposed beside said lighting element, between said lighting element and said corresponding one of the first side of said corresponding one of said at least one cavity and the second side of said corresponding one of said at least one cavity, and adjacent to said corresponding one of said number of plungers.

* * * * *